United States Patent [19]

Hayakawa et al.

[11] 4,311,457

[45] Jan. 19, 1982

[54] BASING HEATING APPARATUS

[75] Inventors: Masatoshi Hayakawa, Nagoya; Koei Ogi, Komaki, Japan

[73] Assignee: CKD Corporation, Komaki, Japan

[21] Appl. No.: 155,086

[22] Filed: Jun. 2, 1980

[30] Foreign Application Priority Data

Jun. 8, 1979 [JP] Japan ..... 54-78134[U]

[51] Int. Cl.[3] ..... F24H 1/00; F24J 3/00

[52] U.S. Cl. ..... 432/222; 432/224; 432/225

[58] Field of Search ..... 432/224, 225, 222, 124, 432/133, 141; 34/105

[56] References Cited

U.S. PATENT DOCUMENTS 3,109,481 11/1963 Yahnke ..... 432/222

3,963,417 6/1976 Placek ..... 432/225

4,006,732 2/1977 Schumm ..... 432/225

4,231,735 11/1980 Downs ..... 432/222

*Primary Examiner*—Henry C. Yuen

*Attorney, Agent, or Firm*—Wenderoth, Lind & Ponack

[57] ABSTRACT

A basing heating apparatus for partially heating a base of a fluorescent tube comprises a hot blast injection head provided along the direction of movement of said fluorescent tube and having an elongated slit for injecting a fluid from within a chamber toward only the base of said tube, an air supply pipe for injecting adjustably pressurized air from the direction linearly aligned to the direction of injection by the slit toward the mixing chamber of said hot blast injection head, and a burner device for injecting a flame from the direction intersecting substantially at right angles the pressurized air introduced into said mixing chamber to heat the pressurized air within said mixing chamber to high temperatures.

4 Claims, 5 Drawing Figures

BASING HEATING APPARATUS

BACKGROUND OF THE INVENTION

In the step of sealably attaching a base to a fluorescent tube, the base prefilled with an adequate quantity of cement is fitted to an end of the fluorescent tube and is heated locally. This local heating was heretofore performed either by direct heating system in which the tube end was heated directly by a flame of a burner or by indirect heating system in which the tube end was heated indirectly by a heating jig. The direct heating system had, however, a disadvantage in that the flame of the burner tended to be brought into direct contact with the glass tube to damage it and required frequent adjustment. The indirect heating system had likewise a disadvantage in that both heating and cooling had to be performed through the jig and, accordingly, the entire operation was slow and inefficient.

SUMMARY OF THE INVENTION

The present invention relates to a heating apparatus applied to a basing apparatus used in a process of producing fluorescent tubes or the like which attaches by fusion a base to an end of the fluorescent tube or the like.

An object of the present invention is to overcome the disadvantages of previously known heating apparatuses by providing a heating apparatus which is easy in adjustment and is capable of heating and cooling the base rapidly.

The apparatus according to the present invention adopts a kind of indirect heating system and is characterized by an air jet used as a heating medium.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

A preferred embodiment of the present invention will now be described with reference to FIGS. 1 to 5.

A fluorescent tube to be heated by the apparatus according to the present invention is resiliently held and supported at opposite ends thereof by means of fluorescent tube support means having holding heads so as to pass a heating zone while revolving on its axis in the direction of the arrow X. A basing heating apparatus 1 according to the present invention is provided in the heating zone.

Figure 4:
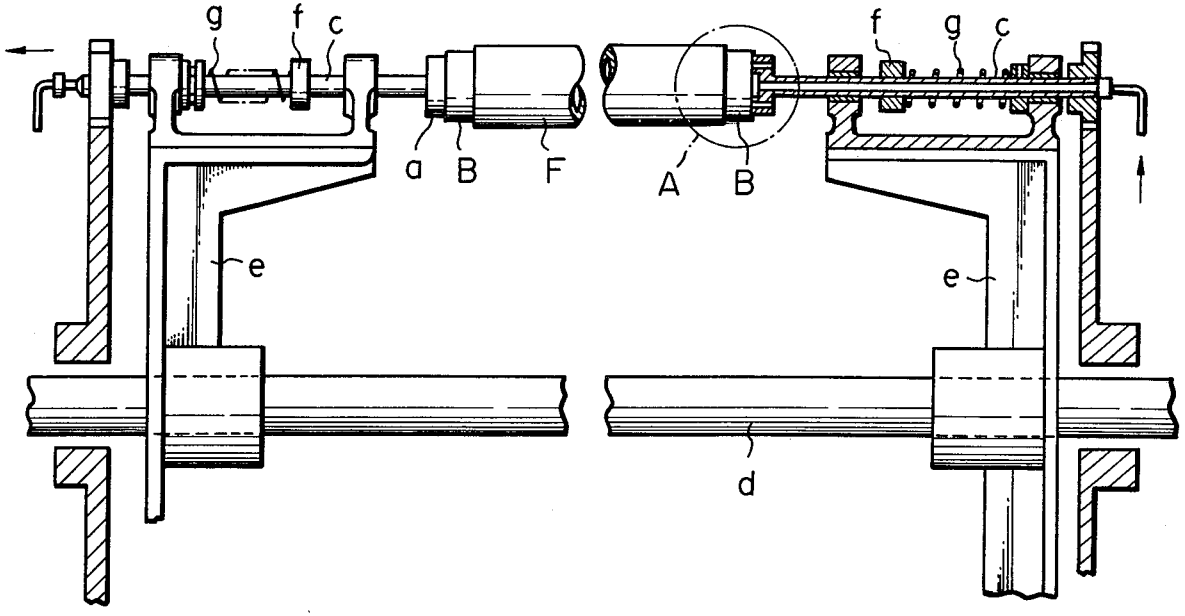
FIG. 4 is a partial sectional view of fluorescent tube support means.
Figure 5:
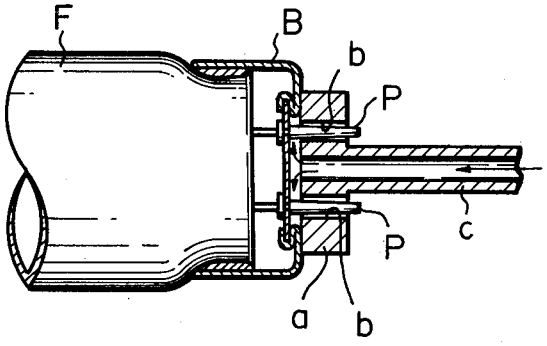
FIG. 5 is an enlarged sectional view of the portion A of FIG. 4.

Said fluorescent tube support means each has, as shown in FIG. 5, a holding head a provided with a hole b for receiving a pin P fixed to a base B joined to an end of a fluorescent tube F. The holding head a has a hollow shaft c formed integrally therewith. The hollow shaft c is, as shown in FIG. 4, mounted so as to be rotatable and axially movable on the periphery of a spider e secured to and rotatable about the main shaft d.

On the hollow shaft c is secured a spring bearing f which is urged by a spring g, whereby the holding head a is urged toward the fluorescent tube.

The basing heating apparatus 1 according to the present invention comprises essentially a hot blast injection head 2 having a mixing chamber 21 therewithin, an air supply pipe 3 and an air supply piping 4 for sending an air jet to the mixing chamber 21 of said hot blast injection head 2, and a burner 5 and a fuel gas feed system 6 for heating the air jet introduced into said mixing chamber 21.

Figure 2:
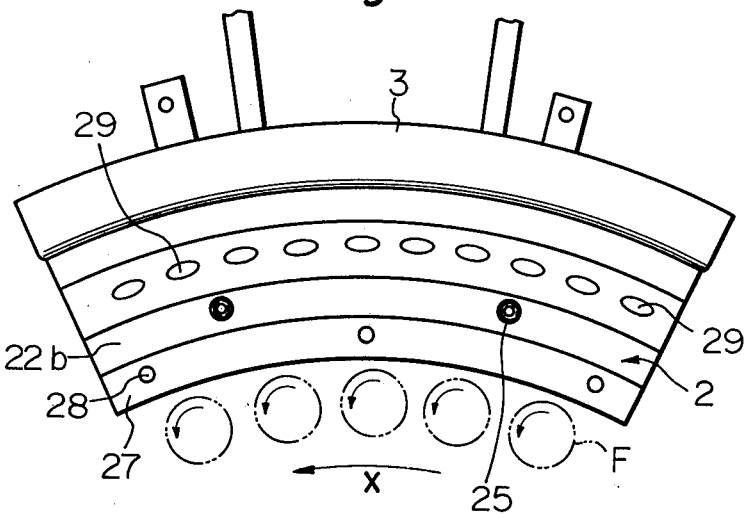
FIG. 2 is a sectional view taken along the line II—II of FIG. 1.
Figure 3:
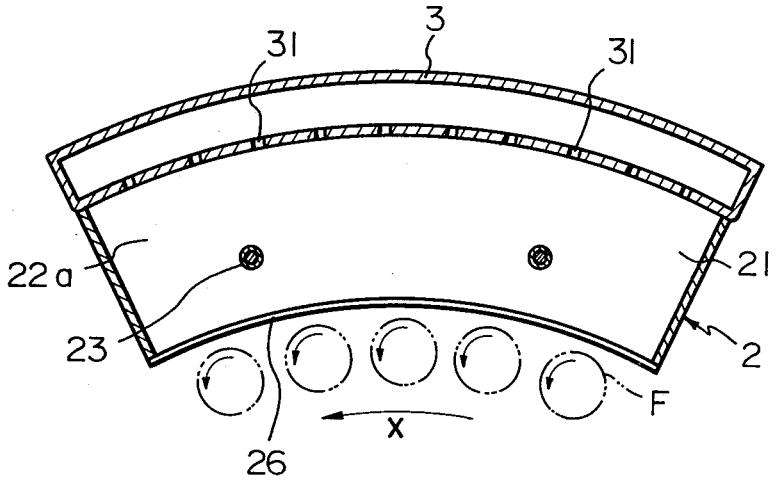
FIG. 3 is a sectional view taken along the line III—III of FIG. 1.

The hot blast injection head 2 is, as shown in FIG. 2, a fan-shaped closed vessel provided on the outer periphery of a path along which a plurality of fluorescent tubes F move while revolving on their own axes. In the hot blast injection head 2, plates 22*a* and 22*b* constituting the fan-shaped side walls as shown in FIG. 2 are secured together by bolts 24 and nuts 25 with a spacer 23 therebetween and are welded at the upper edges thereof to the air supply pipe 3. The hot blast injection head 2 is formed entirely internally with the mixing chamber 21 and at the bottom edge thereof opposite to the base B of the fluorescent tube are secured covers 27, 27 so as to define a slit 26 extending through substantially the entire length of the hot blast injection head 2.

The air supply pipe 3 is provided on the side thereof facing the hot blast injection head 2 with a plurality of equally longitudinally spaced orifices 31 communicated with the mixing chamber, for injecting therethrough air jets at a predetermined pressure from the air supply pipe 3 into the mixing chamber 21.

The air supply pipe 3 is connected to a throttle valve 42 through a conduit 41 of the air supply piping 4 and said throttle valve 42 is connected to an air pressure source (not shown) so that the injection pressure is adjusted by adjusting the throttle valve 42. The direction of the jets via the orifices 31 of the air supply pipe 3 is in linear alignment with the direction of the jet via the split 26 of the hot blast injection head.

The side wall 22*b* of the hot blast injection head 2 is provided with a plurality of windows 29, each of which is combined with the burner 5 of known construction at right angles thereto so that flame 51 of said burner 5 penetrates into the mixing chamber 21 through said window 29 to heat the air jet therein from the perpendicular direction.

Figure 1:
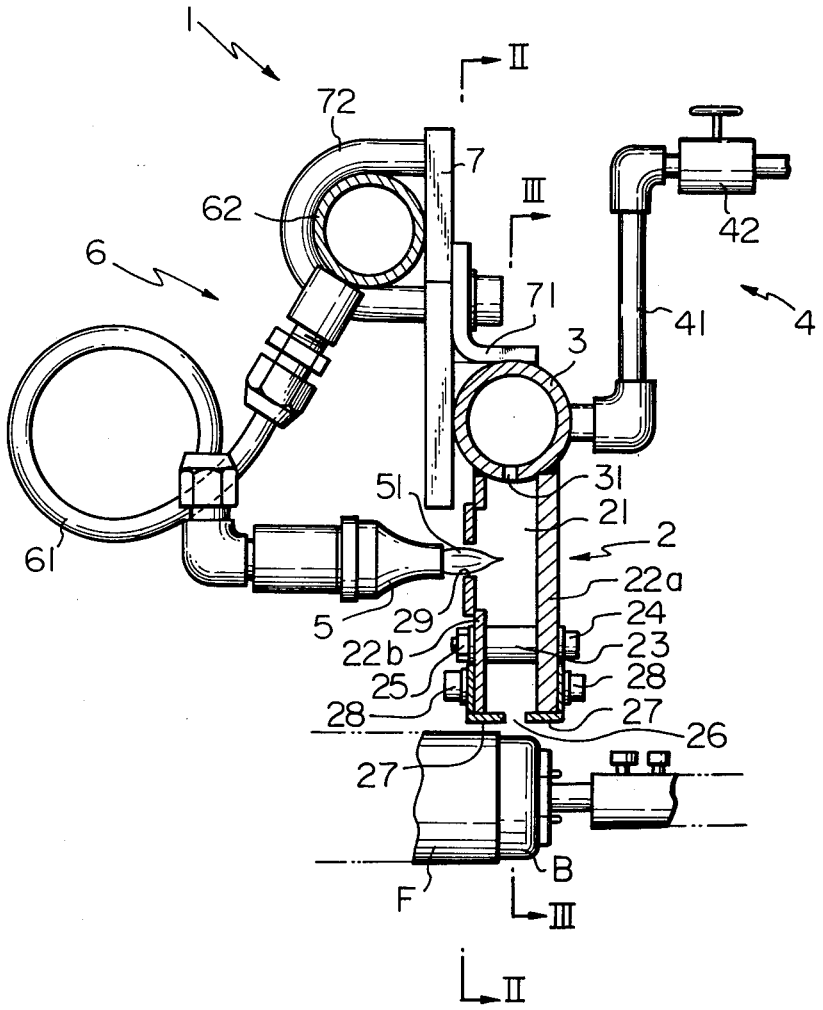
FIG. 1 is a sectional view of an embodiment of the basing heating apparatus according to the present invention.

The burner 5 is connected to a fuel gas feed pipe 62 through a conduit 61 of the fuel gas feed system 6. The fuel gas feed pipe 62 is connected to a fuel gas source (not shown) by known means and is fixed by means of a connector 72 to a fitting plate 7 attached to the air supply pipe 3 by a member 71 so that the conduit 61 and the burner 5 are held as shown in FIG. 1.

In operation of the apparatus according to the present invention, the air jet injected from the orifice 31 of the air supply pipe 3 into the mixing chamber 21 is heated therein by the flame of the burner 5, whereby the heated jet is injected from the slit 26 onto the surface of the base B to heat it. Adjustment of the heating temperature is effected by adjusting the throttle valve 42 thereby adjusting the air jet injection pressure. The burner 5 requires no adjustment as long as it continues stable burning.

In the heating apparatus according to the present invention, heating efficiency is very satisfactory since the base of the fluorescent tube is heated with a heating power equivalent to that in the direct heating by flame, and yet the possibility of damaging the fluorescent tube itself is avoided since the heating medium is air. Further, according to the present invention it is made possible to burn the cement uniformly and to produce fluorescent tubes of high quality since the heating degree can be adjusted simply by operating the throttle valve and the revolving fluorescent tube can be heated uniformly about the base.

While we have shown and described a specific embodiment of our invention, it will be understood that this embodiment is merely for the purpose of illustration and description and that various other forms may be devised with the scope of our invention, as defined in the appended claims.

What is claimed is:

1. A basing heating apparatus for heating partially a base of a fluorescent tube held at opposite ends thereof and moving along a predetermined path while revolving on its axis, comprising:

a hot blast injection head provided along the direction of movement of said fluorescent tube and having an elongated slit for injecting a fluid from within a mixing chamber toward only the base of said tube;

an air supply pipe for injecting an adjustably pressurized air from the direction linearly aligned to the direction of injection by the slit toward the inside of said mixing chamber of said hot blast injection head; and a burner device for injecting a flame from the direction intersecting substantially at right angles said pressurized are introduced into said mixing chamber to heat said pressurized air within said mixing chamber to high temperatures.

2. A basing heating apparatus according to claim 1, characterized in that said hot blast injection head includes a pair of fan-shaped plates fixed with a space therebetween so as to define said mixing chamber and said air supply pipe is welded to one edges of said plates.

3. A basing heating apparatus according to claim 2, in which said plates are provided at the other edges thereof with covers forming a slit for injecting therethrough a hot blast to the base of the fluorescent tube.

4. A basing heating apparatus according to claim 2 or 3, in which one of said plates is provided with a number of windows formed along the direction of movement of the fluorescent tube and said burner device is provided in proximity to each of said windows.

* * * * *